United States Patent [19]

Chin-Fu

[11] Patent Number: 4,750,641

[45] Date of Patent: Jun. 14, 1988

[54] CONTINUOUS WATER-EJECTING PISTOL TOY WITH SIMULTANEOUS SOUND AND RED-FLASH EFFECTS

[76] Inventor: Hun Chin-Fu, 30 San Ho Road Sec. 3, San Chung, Taipei, Taiwan

[21] Appl. No.: 911,167

[22] Filed: Sep. 24, 1986

[51] Int. Cl.[4] ..... F41B 9/00

[52] U.S. Cl. ..... 222/79; 222/318; 222/333; 446/406; 446/473; 446/475

[58] Field of Search ..... 222/79, 39, 23, 78, 222/333, 318, 324, 341; 446/405, 406, 401, 473, 475; 42/54

[56] References Cited

U.S. PATENT DOCUMENTS

| | | | |
|---|---|---|---|
| 825,270 | 7/1906 | Gulliford | 222/79 |
| 2,588,036 | 3/1952 | O'Quinn | 446/473 X |
| 2,734,310 | 2/1956 | Christopher | 446/406 |
| 3,306,495 | 2/1967 | Wabers | 222/318 X |
| 3,381,855 | 5/1968 | Wells | 222/318 X |
| 4,022,350 | 5/1977 | Amron | 222/79 |
| 4,162,037 | 7/1979 | Koyama | 222/333 X |
| 4,171,811 | 10/1979 | Meyer et al. | 446/405 X |
| 4,239,129 | 12/1980 | Esposito | 222/79 |
| 4,365,439 | 12/1982 | Litynski | 446/406 |
| 4,591,071 | 5/1986 | Johnson | 222/79 X |

FOREIGN PATENT DOCUMENTS

| | | | |
|---|---|---|---|
| 907657 | 3/1946 | France | 446/405 |

*Primary Examiner*—Joseph J. Rolla
*Assistant Examiner*—Nils E. Pedersen
*Attorney, Agent, or Firm*—Clifford A. Poff

[57] ABSTRACT

A toy pistol capable of ejecting a continuous stream of water while simultaneously generating a sound and a flashing light. A d-c motor positioned within the toy pistol operates a pump to pump water from a water storage cartridge in order to cause water to be ejected continuously from the toy pistol. The d.c. motor also causes an eccentric cam to rotate, such rotation causing repeated stricking of a sound generating bar, which creates a sound imitating a gun. Operation of the motor additionally causes repeated opening and closing of an electrical circuit containing a light bulb positioned in the barrel of the gun, thereby creating a flashing light effect.

2 Claims, 4 Drawing Sheets

CONTINUOUS WATER-EJECTING PISTOL TOY WITH SIMULTANEOUS SOUND AND RED-FLASH EFFECTS

BACKGROUND OF THE INVENTION

1. Field of the Invention:

The present invention relates generally to toys, and, more particularly, to a toy pistol which ejects a continuous stream of water while simultaneously generating a sound and emitting a flashing light.

2. Description of the Prior Art:

Traditional water-ejecting toy pistols eject water by mechanically pumping water from a water-reservoir located within the pistol body. The pump in most instances is comprised of a spring-biased plunger, one side of which extends outside of the pistol body, thereby creating a trigger, to allow for convenient actuation thereof. A restoring spring is positioned to abut the plunger so as to maintain the plunger in an extended position. A water conduit connects the pump to the gun point, and an additional conduit connects the water-reservoir to the bottom of the pistol body. By exerting force on the plunger, water is caused to be pumped from the water reservoir and to be ejected from the pistol. When the plunger is released, the force of the restoring spring causes the plunger to be returned to its original position. The pump is thereby refilled with water from the water reservoir. Such operation of the conventional water-ejecting toy pistol requires a user to repeatedly exert pressure on, and then release, the plunger in order to operate the toy.

Further, the conventional water-ejecting toy pistols cannot eject a continuous stream of water. Because repeated actuation of the plunger is required to alternately fill a water pump and then eject the water, only intermittent spurts of water may be ejected by the pistol.

It is therefore the object of the present invention to provide a water-ejecting toy pistol which allows a continuous stream of watr to be ejected from the toy.

It is a further object of the present invention to provide a water-ejecting toy pistol which further generates a sound and emits a flashing light during firing of the pistol.

SUMMARY OF THE PRESENT INVENTION

In accordance with the present invention, a continuous water-ejecting toy pistol is disclosed for ejecting water simultaneously with the generation of a sound and a flashing light. The toy pistol is comprised of a pistol body having a front shell and a back shell with a pistol body containing a water-charging opening and an air-exhaust opening at a top portion thereof. A water-supply cartridge is inserted into a cavity in a bottom portion of the pistol body, wherein the cavity is located beneath the water-charging opening and the air-exhaust opening. A trigger is hingedly attached to the pistol body to extend from a bottom portion thereof, and a protector surrounds the trigger. A battery compartment is positioned with a handle portion of the pistol body, for the insertion therewithin of batteries. A spring switch is electrically coupled at a first end thereof to the battery compartment, and contains a second, free end extending to a location above the trigger. A first electrical terminal is positioned above the second, free end of the spring switch. A motor having a rotating shaft, a first contact and a second contact is positioned within the pistol body wherein the first contact is electrically coupled to the first electrical terminal and the second contact is electrically coupled to the battery compartment. A pinion gear is positioned at the end of the rotating shaft of the motor. A reduction gear case and a reduction gear assembly positioned therewithin is contained in the pistol body, wherein the gear assembly is comprised of gear wheels, having a left-most gear wheel engaging with the pinion gear and a right-most gear wheel having a gear shaft extending beyond the reduction gear case. A cam and a turning wheel are connected to the gear shaft of the rightmost gear wheel to allow rotation therewith. A link is rotatably attached at a first end thereof to the turning wheel at an eccentric position on the turning wheel. A pump means having a first and a second opening is further included wherein the pump means includes a piston rod longitudinally positioned within the pistol body. The piston rod is attached to a second end of the link, and the piston abuts a restoring spring. A water-ejection tube is connected to the first opening of the pump means and extends to the exterior of the piston to create the gun point thereby. a water-suction tube is connected to the second opening of the pump means and extends to the water-supply cartridge.

A sound-generating spring plate having a first end thereof fixedly attached to the reduction-gear case contains a second, free end positioned above the cam, wherein the second, free end the sound generating spring plate is bent to form a L-shaped strike part.

A light-generating means includes a light bulb, surrounded by a shade, positiond in a barrel portion of the pistol body wherein the light bulb is electrically coupled to a second terminal positioned on the reduction gear case and to the battery compartment.

In a further embodiment of the present invention, the toy pistol further includes a three-way plug valve and a feedback pipe. The plug valve is positioned between the first opening of the pump means, the water-ejection tube, and the feedback pipe. The feedback pipe connects the plug valve with the water-supply cartridge. Operation of the plug valve allows water to flow between the pump means and the water-ejection tube, or, alternatively, between the pump means and the feedback tube.

BRIEF DESCRIPTION OF THE DRAWINGS

The features and advantages of the present invention may be better understood when the following description is read in light of the enclosed drawings in which:

FIG. 2A is an exploded, sectional view of the water feedback system of the preferred embodiment of the present invention;

DETAILED DESCRIPTION OF THE PREFERRED EMBODIMENT

Figure 1:
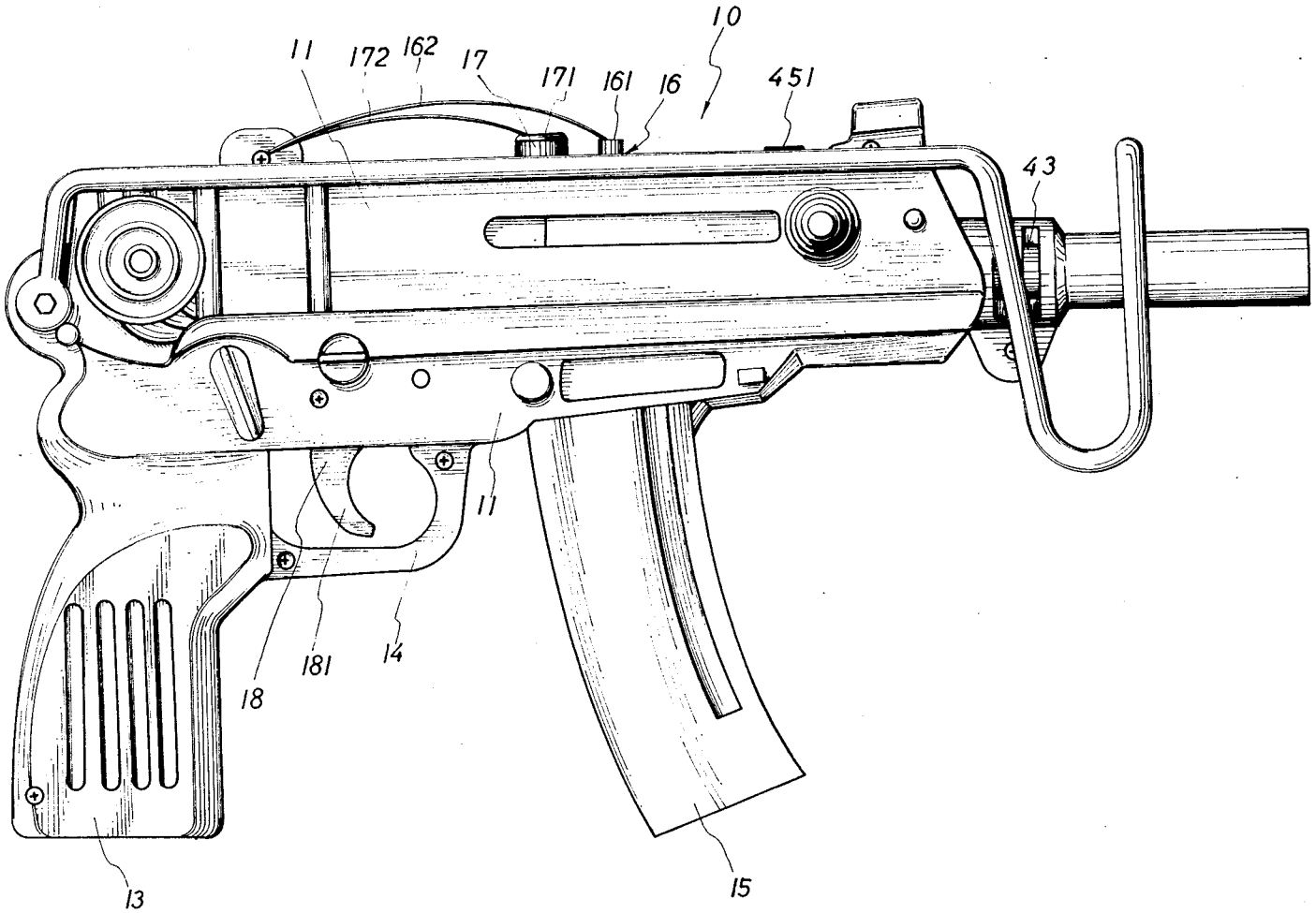
FIG. 1 is a side view, in elevation, of the continuous water-ejecting toy pistol of the present invention.

Referring now to the illustration of FIG. 1, there is illustrated the water-ejecting toy pistol of the present invention having a pistol body 10 comprised of a front shell 11 and back shell (not shown). Each matched shell is preferably manufactured by a plastic-extrusion technique. The pistol body 10 also includes pistol handle 13 and protector 14. A water-supply cartridge 15 engages with the bottom of the pistol body 10 extends into a cavity extending into the body 10. Opening into the pistol body 10 from the top surface thereof are air-exhaust opening 16 and water-charging opening 17. Openings 16 and 17 function to allow the exhaust of air from, and the injection of water into, the pistol body 10. Caps 161 and 171 removably cover openings 16 and 17, and are attached to the pistol body 10 by strings 162 and 172, respectively. Trigger 18 is hingedly attached to pistol body 10 above the protector 14 with the trigger 18 containing a pressing end portion 181.

Figure 2:
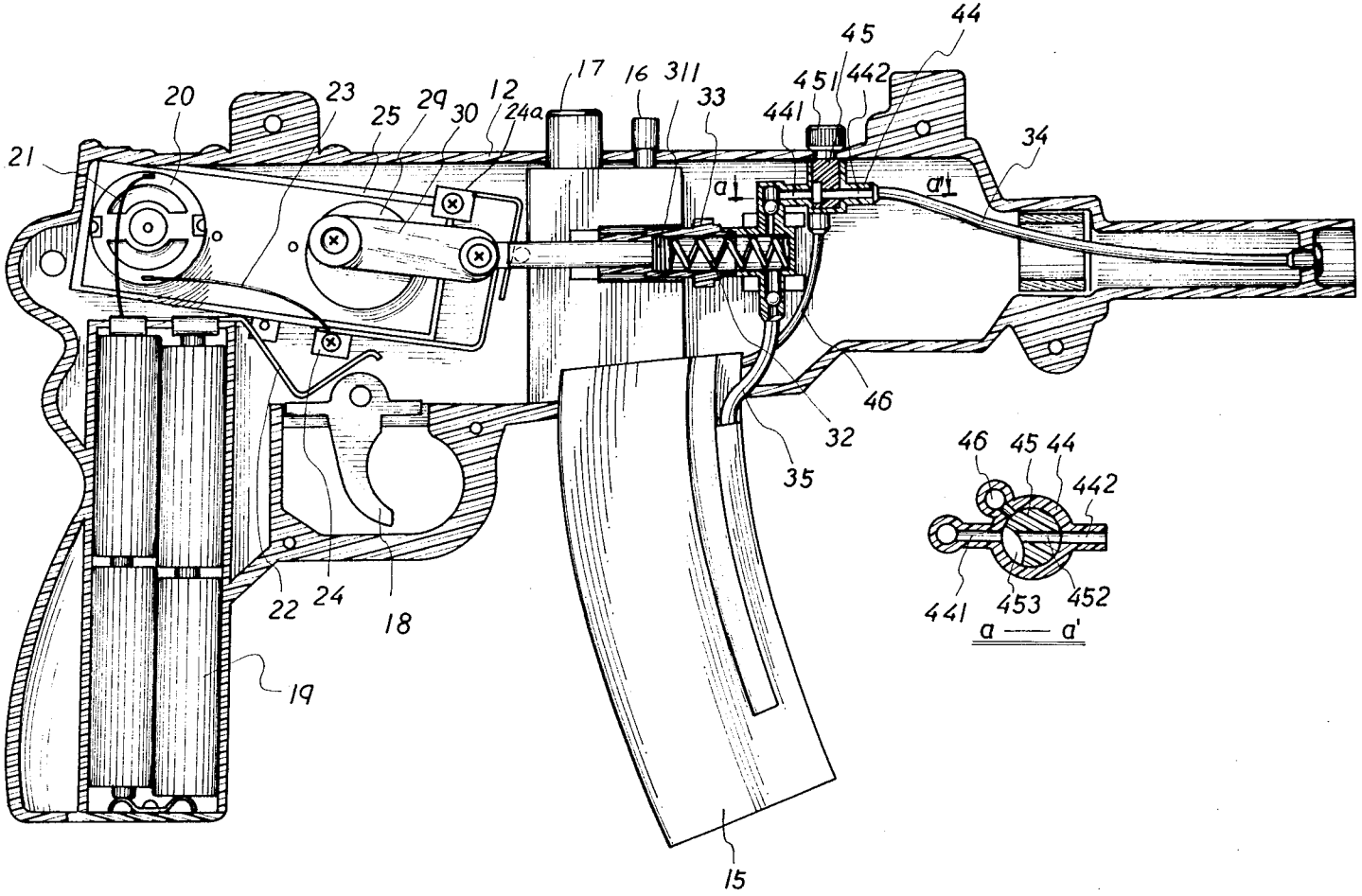
FIG. 2 is a view similar to that of FIG. 1 in which the front shell of the toy pistol has been removed.

Shown in FIG. 2, a battery compartment 19 is located within the pistol handle 13 to allow a number of standard-size dry cell batteries to be postioned therein in order to provide power to operate the toy pistol. The cathode of the battery compartment 19 is connected to negative input-terminal wire 21 of a direct-current motor 20, and the anode of the battery compartment 19 is connected to a metallic spring switch 22. the free end of the spring switch 22 extends above the trigger 18.

Figure 3:
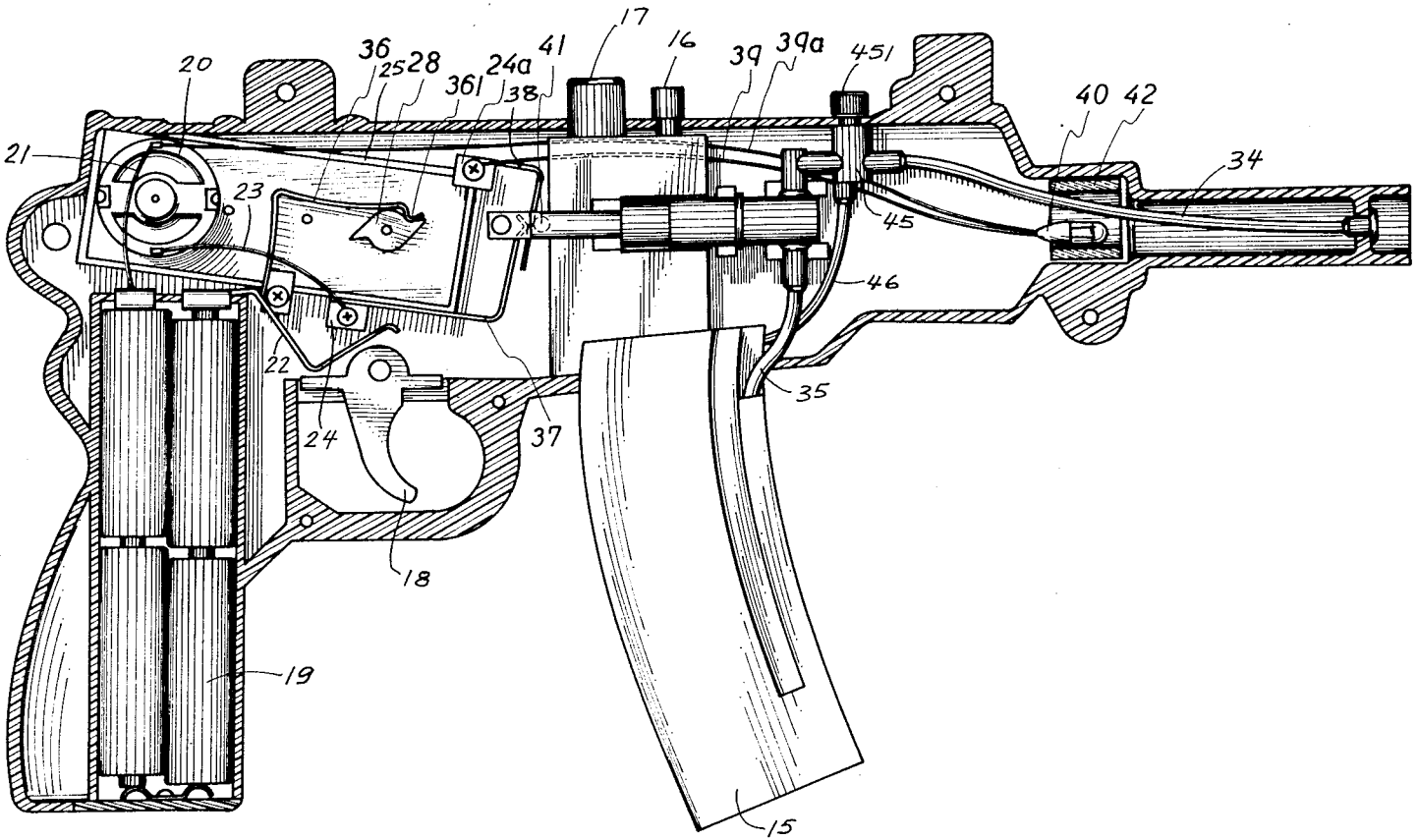
FIG. 3 is a side, elevational view of the water-ejecting toy pistol of the present invention, similar to that of FIG. 2, but illustrating the sound and light generating means of the present invention.
Figure 4:
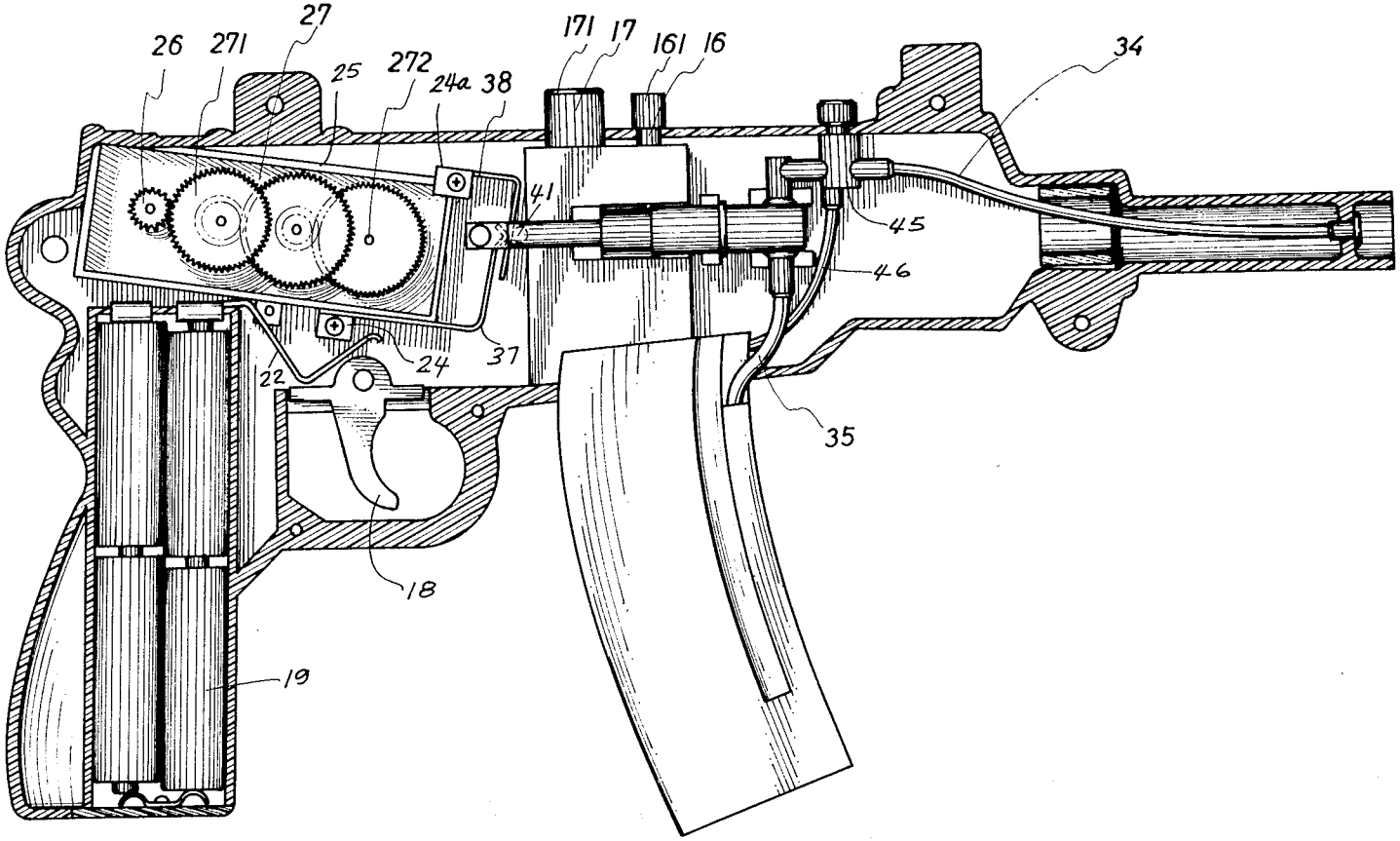
FIG. 4 is a side elevational view of the water-ejecting toy pistol of the present invention illustrating the reduction gear assembly utilized by the present invention.

Positive input-terminal wire 23 of the motor 20 is connected to a fixed terminal 24 mounted to the pistol body 10 above the free end of the spring switch 22. The rotating shaft of the motor extends into a reduction-gear case 25 wherein a pinion gear 26 (illustrated in FIG. 4) fixed onto the end of the motor shaft of motor 20 engages with the left-most gear wheel 271 of reduction-gear assembly 27 positioned within the reduction- gear case 25. Rotation of the motor shaft transmits power through a number of gear wheels. The right-most gear of the reduction-gear assembly 27 contains gear shaft 272 which extends outside the reduction-gear case 25. A cam 28, shown in FIG. 3, and a turning wheel 29, shown in FIG. 2, are connected to the shaft 272 in sequence. a first end of link 30 is rotatably connected to the turning wheel 29 at an eccentric position on the turning wheel 29. A second end of the link 30 is connected to a first end of piston rod 31. A piston 311 is connected at the second end of the piston rod 31, and is permitted to move back and forth, such motion causing expansion and contraction of restoring spring of pump 33. The upper-right portion of the pump 33 contains an opening to allow connection to water-ejection tube 34 which extends to the gun point at the front of the pistol body 10. The lower-right portion of the pump contains an opening to allow connection to water-reduction tube 35 which extends into the water-supply cartridge 15. Both tubes 34 and 35 extend within the pump 33 to allow the respective connections to be made.

The cam 28 (shown in FIG. 3) is shaped so as to contain symmetrical notches at opposite sides of the cam. A first, free end of a sound-generating spring plate 36 is situated at a position slightly above the cam 28, and is fixed at a second end thereof to the reduction gear-case 25. the tail of the free end of sound-generating spring plate 36 is bent so as to form an L-shaped strike part 361 of contour similar to that of notches of the cam 28. Rotation of the cam 28 causes repeated striking of spring plate 36, at strike part 361, thereby generating a sound during rotation of the cam. The sound imitates the sound of a machine gun, particularly when the cam 28 is made of a plastic material.

Fixed terminal 24 is affixed to the reduction-gear case 25, as is a second terminal 24a. Spring plates 37 and 38 attached to terminals 24 and 24a, respectively, extend toward the end portion of the piston rod 31. A radial stem 41 protruding from the piston rod 31 allows physical contact between spring plate 38 and stem 41. The anode of a bulb 40, located in the barrel portion of the pistol body 10, is connected to the terminal 24*a* by conducting wire 39, and the cathode of the bulb 40 is connected to the cathode of the battery compartment 19 by conducting wire 39*a*. A shade 42, preferably of a red, transparent material, covers bulb 40. Slot 43 (shown in FIG. 1) provides an opening on the barrel to allow transmission of the light generated by bulb 40.

In operation, when the trigger 18 is pressed, the free end of spring switch 22 is pushed against the terminal 24, thereby allowing operation of the motor 20. The rotational speed of the motor shaft is reduced through the reduction-gear assembly 27, and power is transmitted from the motor 20, to cause rotation of the turning wheel 29 and the cam 28. Rotation of turning wheel 29 causes translation of the link 30, and, in turn, translation of piston rod 31 and the piston 311 attached thereto. Once the piston 311 is translated to the right-most position, it is then pushed back by the restoring spring 32. Rightward translation of piston 311 causes a pressure differential to be generated within the pump 33, thereby causing water to be ejected through the water-ejection tube 34. As the force of the restoring spring 32 causes the piston 311 to be translated leftward, a reduction in internal pressure results, causing water from the water-supply cartridge 15 to enter into the pump 33. As long as the trigger 18 is pressed and held, both the motor 20 and the turning wheel 29 will rotate the piston 311 will be driven to move back and forth within the pump 33, and water within the pump 33 will be alternatively ejected and refilled to allow a continuous stream of water to be ejected from the pistol.

Also during operation of the present invention, rightward translation of the piston rod 31 causes the free end of conducting spring plate 38 to be separated from the conducting spring plate 37. The electrical circuit containing bulb 30 is opened, thereby preventing the bulb 40 from lighting. When the piston rod 31 is caused to be translated leftwardly, the free end of the conducting spring plate 38 is allowed to contact with the conducting spring plate 37, closing the electrical circuit containing bulb 40. In this manner, translation back and forth of piston rod 31 within the pump 33 allows the bulb 40 to be turned on and off. Since the bulb 40 is covered with a red-colored lamp shade 42, red-colored light is emitted near the gun point of the pistol body 10. This flashing light increases the entertainment value of the toy.

Additionally during operation of the present invention, rotation of cam 28 causes strike part 361 of sound-generating spring plate 36 to be raised slightly by the convex part of the cam 28, thereby compressing spring plate 36. After further rotation of cam 28, the notched part of the cam 28 is hit by the strike part 361 of spring plate 36, as the plate springs back to its unbiased condition. In so doing, sound is generated. Because cam 28 contains two notches, cam 28 is hit twice during each revolution of the cam 28. Because cam 28 is driven to rotate continuously, sound is generated continuously during operation of the toy pistol.

Referring now to FIG. 2 and the cross-sectional view of FIG. 2a, a further feature of the present invention is illustrated. A valve 44 is located between the pump 33 and the water-ejection tube 34. Water inlet 441 and water outlet 442 connect with the inside of the valve 44 at opposite ends thereof respectively. Water inlet 441 is also connected to the pump 33 and the water outlet 442 is also connected to the water ejection tube 34. Positioned in the valve 44 is plug 45 containing a passageway 452 therethrough. Plug 45 has an associated valve stem 451 extending therefrom. The valve stem 451 may be manually rotated to open or close the valve 45. Passageway 452 extending through plug 45 is designed with a concave portion 453. Feedback pipe 46 is positioned so as to extend between valve 44 and water-supply cartridge 15. When the valve stem 451 is rotated such that passageway 452 of the plug 45 is aligned with the water inlet 441 and the water outlet 442, water may be ejected through the water ejection tube 34 during operation of the pistol. Alternatively, when the valve stem 451 is rotated such that the water outlet 442 is blocked by the plug 45, no water is allowed into water ejection tube 34. However, when the plug 45 is rotated into this position, the gap created by the concave portion 453 of plug 45 allows water to flow from the water inlet 441 into feedback pipe 46. Water is thereby returned to the water-supply cartridge 15 through the feedback pipe 46. alternate operation of toy pistol is thereby allowed, such that when the trigger 18 is pressed, only sound is generated and a flashing light is emitted.

In summary, the present invention is a novel design for a continuous water-ejecting toy pistol, which simultaneously also a generates sound and emits a flashing light during operation thereof. A further feature of the present invention allows one to play with the toy pistol with only the sound and flashing light effects.

While the present invention has been described in connection with the preferred embodiment shown in the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A toy pistol comprised of a pistol body having a front shell and a back shell with the pistol body containing a water charging opening and an air-exhaust opening at a top portion thereof, and a cavity extending into a bottom portion thereof beneath the water-charging opening and the air-exhaust opening;

a water-supply cartridge for insertion into said cavity in the bottom portion of the pistol body;

a trigger hingedly attached to the pistol body and extending from the bottom portion thereof;

a protector surrounding said trigger;

a battery compartment positioned within a handle portion of the pistol body, said battery compartment suitable for insertion therewithin of batteries;

a spring switch having a first end and a second, free end, with said first end being electrically coupled to the battery compartment, and said second, free end extending to a position above the trigger;

a first electrical terminal positioned above the second, free end of the spring switch;

a motor having a rotating shaft, a first contact, and a second contact, with said motor being positioned within the pistol body to allow the first contact to be electrically coupled to the first electrical terminal, and the second contact to be electrically coupled to the battery compartment;

a pinion gear positioned on an end portion of the rotating shaft of the motor;

a reduction gear case having a reduction gear assembly positioned therewithin, said reduction gear assembly comprised of gear wheels, wherein a left-most gear wheel engages with said pinion gear and a gear shaft of a right-most gear wheel extends beyond the reduction gear case;

a cam positioned on the gear shaft of the right-most gear wheel;

a turning wheel positioned on the gear shaft of the right-most gear wheel;

a link rotatably attached at a first end thereof to the turning wheel at a eccentric position on the turning wheel;

a pump means having a first and second opening, said pump means further including a restoring spring and a piston having a piston rod positioned to extend longitudinally within the piston body, with said piston stem being rotatably attached to a second end of the link, and with said piston abutting the restoring spring;

a water-ejection tube connected to said first opening of the pump means, said water-ejection tube extending to the exterior of the pistol body to create a gun point thereby;

a water-suction tube connected to the second opening of the pump means, said water-ejection tube extending to the water-supply cartridge;

a sound-generating spring plate having a first end thereof fixedly attached to the reduction gear case, and having a second, free end positioned above the cam said second free end of the sound-generating spring plate being bent to form an L-shaped strike part;

a light-generating means including a light bulb positioned in a barrel portion of the pistol body, said light bulb being electrically coupled to a second terminal positioned on the reduction gear case, and being electrically coupled to an anode portion of the battery compartment; and a shade positioned about the light bulb.

2. The continuous water-ejecting toy pistol of claim 1 further including a three-way plug valve and a feedback pipe connecting with the water-supply cartridge, wherein said three-way plug valve is positioned between the first opening of the pump means, the water-ejecting tube, and the feedback pipe to allow water to flow between the pump means and the water-ejection tube, or, alternatively, between the pump means and the feedback tube.

* * * * *